US011752592B2

(12) United States Patent
Liao et al.

(10) Patent No.: US 11,752,592 B2
(45) Date of Patent: Sep. 12, 2023

(54) SLURRY ENHANCEMENT FOR POLISHING SYSTEM

(71) Applicant: Taiwan Semiconductor Manufacturing Co., Ltd., Hsinchu (TW)

(72) Inventors: Chun-Hung Liao, Taichung (TW); Chen-Hao Wu, Hsinchu (TW); An-Hsuan Lee, Hsinchu (TW); Huang-Lin Chao, Hillsboro, OR (US)

(73) Assignee: Taiwan Semiconductor Manufacturing Co., Ltd., Hsinchu (TW)

( * ) Notice: Subject to any disclaimer, the term of this patent is extended or adjusted under 35 U.S.C. 154(b) by 0 days.

(21) Appl. No.: 17/377,759

(22) Filed: Jul. 16, 2021

(65) Prior Publication Data

US 2023/0021172 A1 Jan. 19, 2023

(51) Int. Cl.
*B24B 53/017* (2012.01)
*B24B 57/02* (2006.01)

(52) U.S. Cl.
CPC ..... *B24B 53/017* (2013.01); *B24B 57/02* (2013.01)

(58) Field of Classification Search
CPC ..... B24B 53/017
USPC ..... 451/41, 56, 57, 60, 65, 66, 285, 287
See application file for complete search history.

(56) References Cited

U.S. PATENT DOCUMENTS

| | | | | |
|---|---|---|---|---|
| 6,364,744 | B1 * | 4/2002 | Merchant | C09K 3/1463 451/6 |
| 6,694,284 | B1 * | 2/2004 | Nikoonahad | G01N 21/94 702/155 |
| 6,821,895 | B2 * | 11/2004 | Lin | B24B 57/02 438/692 |
| 6,866,567 | B2 * | 3/2005 | Gotkis | B24B 53/017 451/60 |
| 2002/0104269 | A1 * | 8/2002 | Sun | C09G 1/02 106/3 |
| 2014/0273752 | A1 * | 9/2014 | Bajaj | B24B 49/18 451/6 |
| 2017/0066101 | A1 * | 3/2017 | Yamaguchi | H01L 21/67046 |
| 2019/0080947 | A1 * | 3/2019 | Koide | H01L 21/67383 |
| 2020/0039022 | A1 * | 2/2020 | Kung | B24B 37/24 |

* cited by examiner

*Primary Examiner* — Anne M Kozak
*Assistant Examiner* — Christopher Soto
(74) *Attorney, Agent, or Firm* — Sterne, Kessler, Golstein & Fox P.L.L.C.

(57) ABSTRACT

The present disclosure describes a method and an apparatus that can enhance the slurry oxidizability for a chemical mechanical polishing (CMP) process. The method can include securing a substrate onto a carrier of a polishing system. The method can further include dispensing, via a feeder of the polishing system, a first slurry towards a polishing pad of the polishing system. The method can further include forming a second slurry by enhancing an oxidizability of the first slurry, and performing a polishing process, with the second slurry, on the substrate.

20 Claims, 9 Drawing Sheets

600

SLURRY ENHANCEMENT FOR POLISHING SYSTEM

BACKGROUND

Chemical mechanical polishing or planarization (CMP) is a process for smoothing and planarizing surfaces with a combination of chemical and mechanical forces. CM P uses an abrasive chemical slurry in conjunction with a polishing pad and a retaining ring. In semiconductor fabrication, CMP is used to planarize and polish different types of materials (e.g., dielectrics, metals, and semiconductors) having a crystalline, polycrystalline, or amorphous microstructures.

BRIEF DESCRIPTION OF THE DRAWINGS

Aspects of this disclosure are best understood from the following detailed description when read with the accompanying figures.

Illustrative embodiments will now be described with reference to the accompanying drawings. In the drawings, like reference numerals generally indicate identical, functionally similar, and/or structurally similar elements.

DETAILED DESCRIPTION

Figure 1:
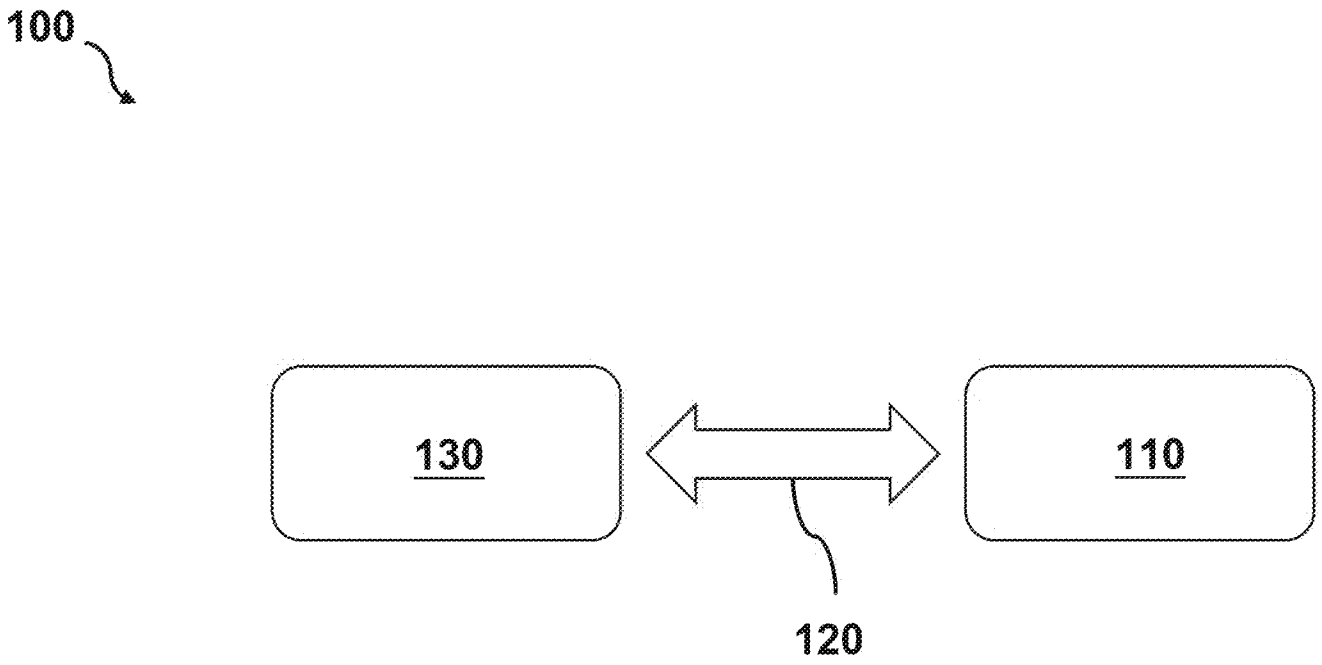
FIG. 1 illustrates a block diagram of a polishing system, according to some embodiments.

It is noted that references in the specification to "one embodiment," "an embodiment," "an example embodiment," "exemplary," etc., indicate that the embodiment described may include a particular feature, structure, or characteristic, but every embodiment may not necessarily include the particular feature, structure, or characteristic. Moreover, such phrases do not necessarily refer to the same embodiment. Further, when a particular feature, structure or characteristic is described in connection with an embodiment, it would be within the knowledge of one skilled in the art to effect such feature, structure or characteristic in connection with other embodiments whether or not explicitly described.

It is to be understood that the phraseology or terminology herein is for the purpose of description and not of limitation, such that the terminology or phraseology of the present specification is to be interpreted by those skilled in relevant art(s) in light of the teachings herein.

Spatially relative terms, such as "beneath," "below," "lower," "above," "upper," and the like may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

In some embodiments, the terms "about" and "substantially" can indicate a value of a given quantity that varies within 5% of the value (e.g., ±1%, ±2%, ±3%, ±4%, ±5% of the value). These values are merely examples and are not intended to be limiting. The terms "about" and "substantially" can refer to a percentage of the values as interpreted by those skilled in relevant art(s) in light of the teachings herein.

Chemical mechanical planarization (CMP) is a planarization technique to planarize a wafer's surface. The CMP process applies a pressure and a relative motion between the wafer and a polishing pad in the presence of a slurry between the wafer and the polishing pad. The slurry can chemically react with the wafer surface to remove specific materials from the wafer surface during the CMP process. For example, the slurry can include an oxidizer to oxidize the wafer surface to form an interface oxide thereon. The interface oxide can be subsequently removed by the pressure and the relative motion between the wafer and the polishing pad during the CMP process. However, the slurry's oxidizer can degrade over time because the slurry's oxidizer can gradually react with the atmosphere or other chemical compounds (e.g., abrasives and/or wet etchants) in the slurry. Accordingly, the slurry's oxidizability (e.g., ability to oxidize a target material, such as oxidizing the wafer surface) can degrade over time, thus degrading the CMP process's yield and reliability.

To address the aforementioned challenges, this disclosure is directed to a method and a CMP apparatus that enhances a slurry's oxidizability and performs a CMP process on a substrate using the enhanced slurry. The CMP apparatus can include a slurry feeder that receives the slurry. The slurry can include a raw slurry that has a moderate or degraded oxidizability. The CMP apparatus can further include a slurry enhancement module to enhance the oxidizability of the received slurry. The slurry enhancement module can include an ultraviolet (UV) light source to irradiate the slurry to generate radicals, such as hydrogen radicals, in the slurry. The slurry with the radicals can have a stable and enhanced oxidizability to oxidize the substrate surface for the CMP process. Since the UV light source can irradiate the received slurry before or during the CMP process, the enhanced slurry can be consistently supplied to the CMP apparatus to perform the CMP process. A benefit of the present disclosure, among others, is to ensure or boost the oxidizability of the slurry, thus improving the CMP process's yield and reliability.

FIG. 1 is a block diagram of a polishing system 100 for a polishing process, according to some embodiments of the present disclosure. As illustrate in FIG. 1, polishing system 100 can include a polishing apparatus 110, a communication link 120, and a computer system 130, where polishing apparatus 110 and computer system 130 can be configured to communicate with each other via communication link 120. Polishing apparatus 110 can be configured to perform a polishing process, such as a CMP process, based on instructions received from computer system 130. In some embodiments, the CMP process can include a substrate polishing process or a conditioning process. Polishing apparatus 110 can include a polishing pad (not shown in FIG. 1) and a slurry enhancement module (not shown in FIG. 1) configured to enhance an oxidizability of a slurry for the polishing process. Polishing apparatus 110 can be further configured to send data associated with the detected profile to computer system 130. In some embodiments, communication link 120 can be a wire or wireless link between polishing apparatus 110 and computer system 130.

Computer system 130 can be configured to store the polishing process instructions, which can include one or more polishing process parameters. Computer system 130 can be further configured to send the instructions to polishing apparatus 110 via communication link 120. Computer system 130 can receive the data of the detected profile from polishing apparatus 110 and can be configured to generate an adjustment of the one or more parameters of the polishing process. Computer system 130 can be further configured to update the instructions based on the adjustment.

Figure 2A:
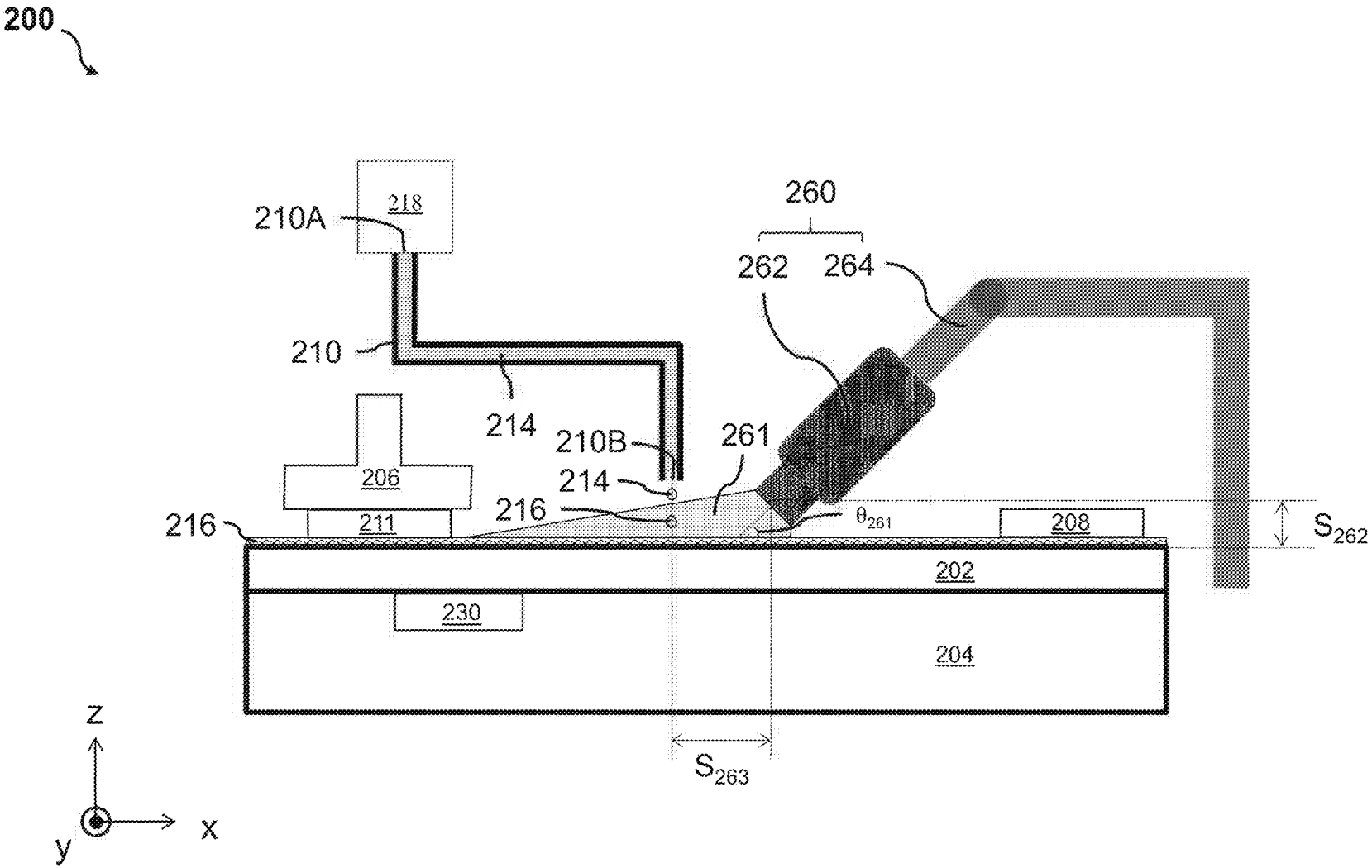
FIG. 2A illustrates a side view of a polishing apparatus, according to some embodiments.
Figure 2B:
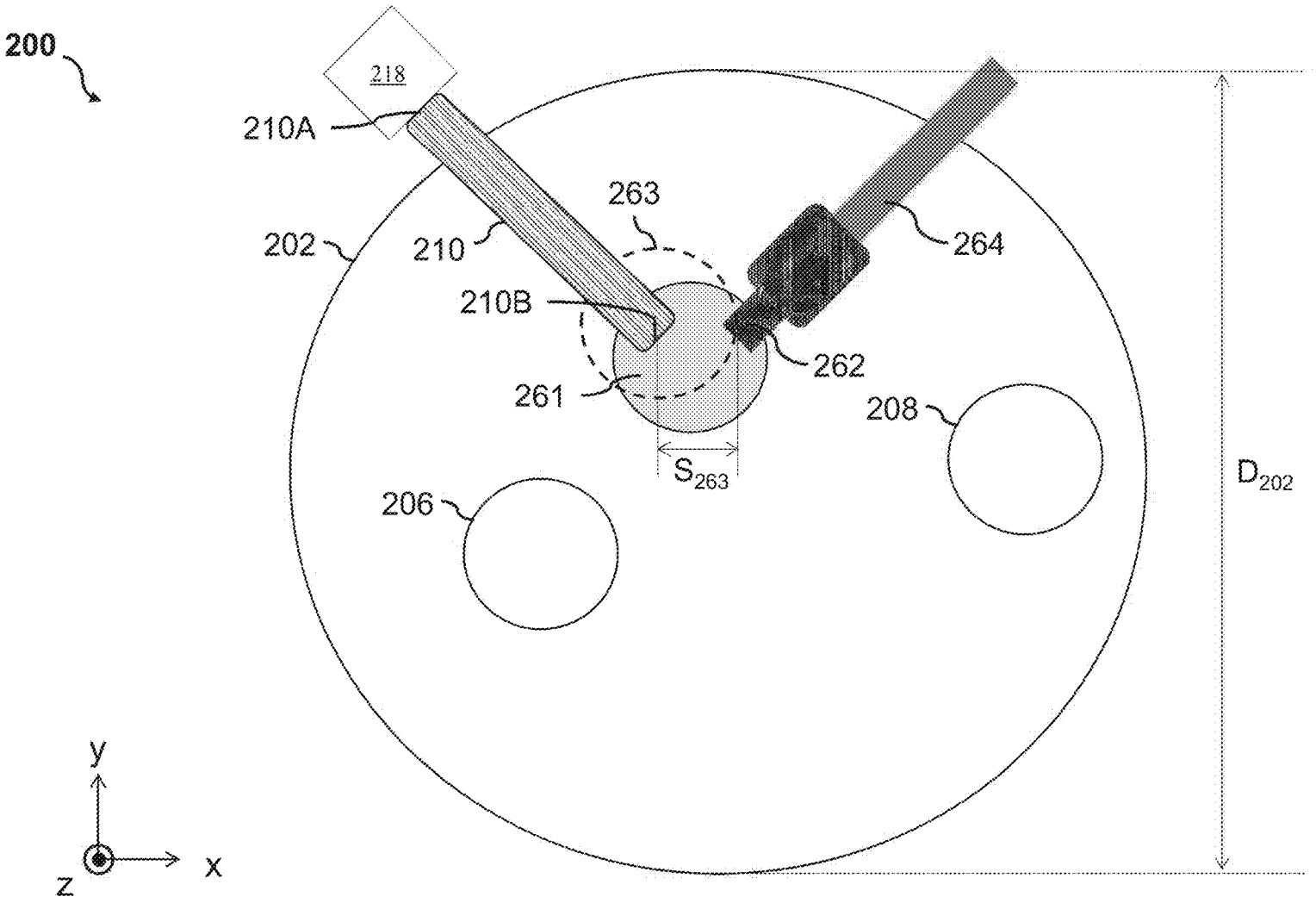
FIGS. 2B and 2C illustrate top views of a polishing apparatus, according to some embodiments.
Figure 2C:
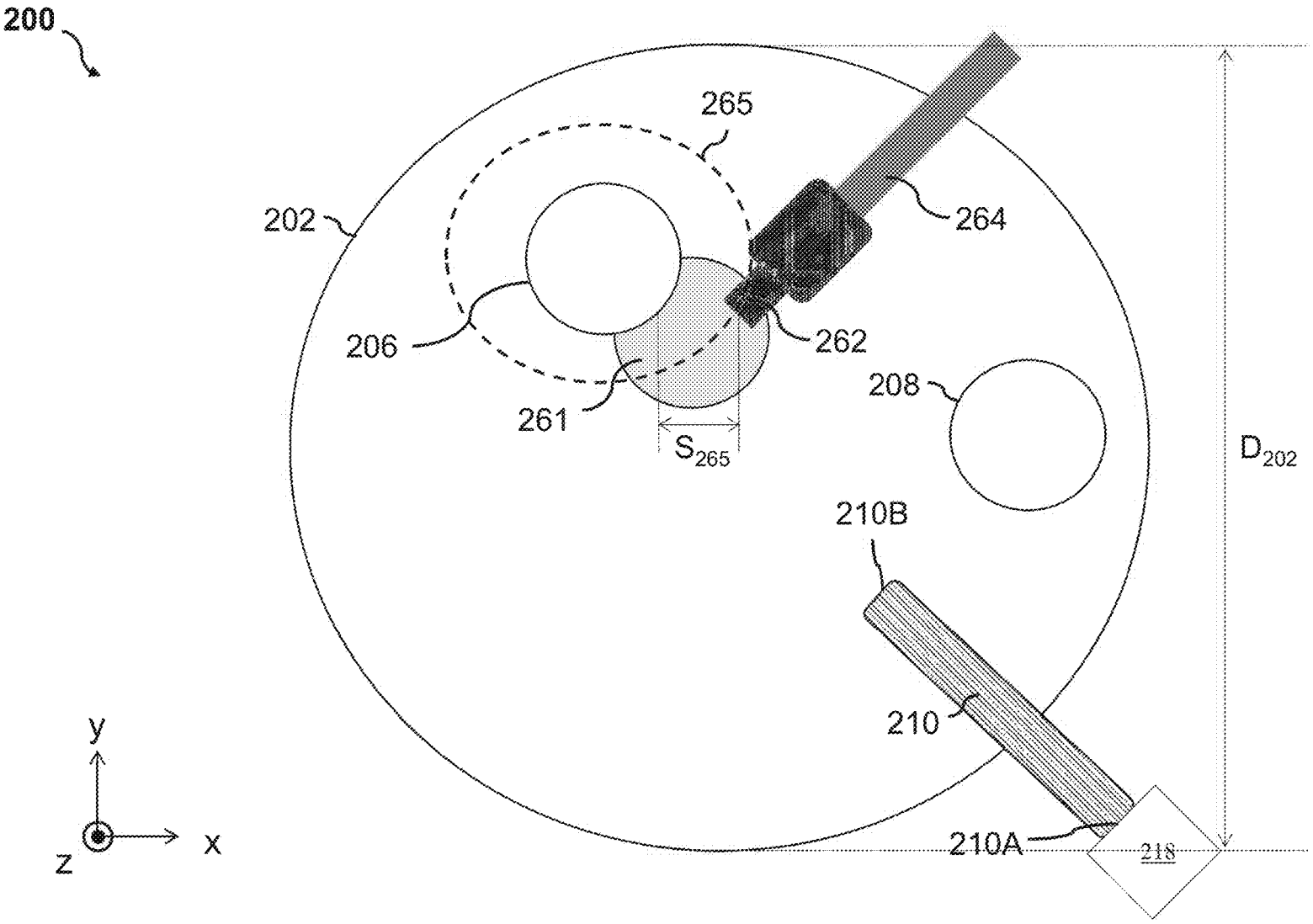

FIG. 2A illustrates a side view of a polishing apparatus 200 (hereinafter "polisher 200") configured to perform a CMP process on a substrate 211, according to some embodiments. FIGS. 21B and 2C illustrate top views of polisher 200 of FIG. 2A, according to some embodiments. The discussion of elements with the same annotations in FIGS. 1 and 2A-2C applies to each other, unless mentioned otherwise. Polisher 200 can be an embodiment of polishing apparatus 110. Referring to FIG. 2A, polisher 200 can include a polishing pad 202, a platen 204 that can hold polishing pad 202, a substrate carrier 206 disposed over polishing pad 202, and a pad conditioner 208 disposed over polishing pad 202.

Polishing pad 202 can be a circular plate with a suitable diameter $D_{202}$, such as from about 15 inches to about 30 inches, to polish semiconductor substrate 211. For example, polishing pad 202 can be rotated and pressed in contact with substrate 211 at a specific pressure to perform the CMP process on substrate 211. Polishing pad 202 can have any suitable size, such as several times the diameter of semiconductor substrate 211, to perform the CMP process on substrate 211. Polishing pad 202 can have any suitable compressibility to conform to substrate 211 on a long range scale, such as from about 30 cm to about 50 cm, to uniformly polish substrate 211. In some embodiments, polishing pad 202 can be made of a hard polishing material, such as urethane and polymer, that can have a hard and incompressible surface to polish substrate 211. In some embodiments, polishing pad 202 can be made of a soft polishing material, such as polyurethane, that can have a soft surface to polish substrate 211. Based on the disclosure herein, other materials, size, and compressibility for polishing pad 202 are within the scope and spirit of this disclosure.

Platen 204 can support and rotate polishing pad 202. For example, polishing pad 202 can be mounted on platen 204 with an adhesive (not shown in FIG. 2A), and platen 204 can include a motor (not shown in FIG. 2A) to provide a rotational force to rotate polishing pad 202 around an imaginary rotational axis perpendicular to a top surface of platen 204. Accordingly, platen 204 can rotate polishing pad 202 in a clockwise direction or in a counter-clockwise direction. In some embodiments, substrate carrier 206 and polishing pad 202 can rotate independently in the same direction or different directions with the same or different rotational speed.

Substrate carrier 206 can secure substrate 211 thereon. For example, substrate carrier 206 can include a retainer ring (not shown in FIG. 2A) to keep substrate 211 in a predetermined position and prevent detachment of substrate 211 from substrate carrier 206. In some embodiments, substrate carrier 206 can apply a vacuum to secure substrate 211 on substrate carrier 206. Substrate carrier 206 can bring substrate 211 in contact with polishing pad 202, thereby polishing substrate 211's surface. In some embodiments, substrate carrier 206 can further include a rotatable shaft (not shown in FIG. 2A) to rotate semiconductor substrate 211.

Pad conditioner 208 can extend over the top of polishing pad 202 to condition polishing pad 202, such as roughen and texturize the surface of polishing pad 202. Due to the conditioning performed by pad conditioner 208, polishing pad 202's surface roughness can be restored to maintain the CMP process's polishing rate. Pad conditioner 208 can include any suitable material layer, such as a diamond-contained layer and a diamond-like carbon (DLC) layer, for conditioning polishing pad 202. In some embodiments, pad conditioner 208 can be a circular disk that can be rotated to apply a pressure to condition polishing pad 202. Based on the disclosure herein, other materials and shapes for pad conditioner 208 are within the scope and spirit of this disclosure.

Polisher 200 can further include a mixing tank 218 that can mix a raw slurry and deionized water to provide a slurry 214. The raw slurry can be a mixture of chemicals that can include an oxidizer (e.g., hydrogen peroxide), an abrasive, a chelator, a surfactant, a corrosion inhibitor, a wetting agent, a removal rate enhancer, a biocide, a pH adjuster, and/or water. The raw slurry's oxidizer can be slurry 214's oxidizer that can determine slurry 214's oxidizability (e.g., ability to oxidize substrate 211's surface). For example, slurry 214's oxidizability can be determined based on the standard electrode potentials (e.g., oxidizing strength) of slurry 214's oxidizer and/or the concentration of slurry 214's oxidizer. In some embodiments, slurry 214's oxidizer may degrade over time because slurry 214's oxidizer may react with atmosphere or other chemicals of slurry 214. Accordingly, the concentration of slurry 214's oxidizer may be reduced over time, thus degrading slurry 214's oxidizability.

Polisher 200 can further include a feeder 210 that can receive slurry 214 from mixing tank 218 and can dispense slurry 214 towards polishing pad 202. For example, feeder 210 can include an inlet 210A fluidly connected to mixing tank 218. Feeder 210 can receive slurry 214 from mixing tank 218 through inlet 210A. Feeder 210 can further include an outlet 210B disposed over polishing pad 202. Feeder 210 can dispense slurry 214 towards polishing pad 202. In some embodiments, feeder 210 can include a motion mechanism (not shown in FIG. 2A) to sweep across polishing pad 202. Accordingly, feeder 210 can dispense slurry 214 towards various locations of polishing pad 202. In some embodiments, feeder 210 can include a flow regulator (not shown in FIG. 2A) fluidly connected between inlet 210A and outlet 210B. The flow regulator can control a flow rate of slurry 214 flowing between inlet 210A and outlet 210B. In some embodiments, the flow regulator can be a mass flow controller, a flow control valve, a proportional valve, or a solenoid valve.

Polisher 200 can further include a slurry enhancement module 260 to enhance the oxidizability of a slurry dispensed by feeder 210. For example, slurry enhancement module 260 can enhance the oxidizability of slurry 214 that is dispensed from feeder 210's outlet 210B. Accordingly, slurry 214 with enhanced oxidizability (hereinafter "slurry 216") can be dispensed onto polishing pad 202 to perform the CMP process on substrate 211. Since slurry 216's oxidizability can be greater than slurry 214's oxidizability, the previously discussed slurry 214's degradation can be reconciled to ensure the reliability and the yield of the CMP process performed by polisher 200. In some embodiments, slurry enhancement module 260 can enhance slurry 214's oxidizability to generate slurry 216 less than about 1 millisecond, less than about 10 milliseconds, less than about 100 milliseconds, or less than about 1000 milliseconds. If the time to generate slurry 216 is beyond the above-noted upper limits, portions of slurry 214 with degraded oxidizability may be dispensed, via feeder 210, onto polishing pad 202 to react with substrate 211, thus degrading the CMP process performed by polisher 200. In some embodiments, polisher 200 can include a chamber (not shown in FIG. 2A) that can accommodate slurry enhancement module 260, polishing pad 202, feeder 210, substrate carrier 206, and pad conditioner 208.

Slurry enhancement module 260 can include an irradiation source 262 to generate an irradiation 261 to irradiate slurry 214. For example, irradiation source 262 can irradiate, via irradiation 261, the proximities of feeder 210's outlet 210B. In some embodiments, irradiation source 262 can irradiate, via irradiation 261, a space between polishing pad 202 and feeder 210's outlet 210B. In some embodiments, irradiation source 262 can irradiate, via irradiation 261, portions of polishing pad 202 under and proximate to feeder 210's outlet 210B. In some embodiments, irradiation source 262 can irradiate, via irradiation 261, portions of polishing pad 202 under and proximate to substrate carrier 206. Irradiation 261 can be a short wavelength electromagnetic radiation, such as an ultraviolet light irradiation, an ultraviolet laser irradiation, a microwave irradiation, and an x-ray irradiation, that can react with slurry 214's oxidizer to generate the oxidizer radicals. For example, slurry 214 can include hydrogen peroxide ($H_2O_2$) as the oxidizer, and slurry 214's oxidizer (e.g., $H_2O_2$) can react with irradiation 261 to generate hydroxyl radicals (e.g., OH* and/or OOH*). The generated oxidizer radicals (e.g., hydroxyl radicals) can be mixed with slurry 214's other chemicals (e.g., the abrasive, the chelator or the surfactant, etc.) to form slurry 216. Because slurry 216's oxidizer radicals (e.g., hydroxyl radicals) can have a greater oxidizability than slurry 214's oxidizer (e.g., hydrogen peroxide), slurry 216 can have a greater oxidizability than slurry 214.

In some embodiments, a CMP process that uses a slurry (e.g., slurry 216) with higher oxidizability can have a higher polishing rate than another CMP process that uses another slurry (e.g., slurry 214) with reduced oxidizability. In some embodiments, irradiation 261 can have a wavelength from about 200 nm to about 500 nm, from about 200 nm to about 400 nm, or from about 250 nm to about 400 nm. If irradiation 261's wavelength is beyond the above-noted upper limits, irradiation 261 may not have sufficient photonic energy to generate the oxidizer radicals from slurry 214. If irradiation 261's wavelength is below the above-noted lower limits, irradiation 261 may damage polishing pad 202's chemical composition, such as damaging polishing pad 202's polymer layer, to degrade the CMP process performed by polisher 200. In some embodiments, irradiation source 262 can include a power meter (not shown in FIG. 2A) to adjust irradiation 261's power. For example, irradiation 261's power, adjusted by irradiation source 262's power meter, can be from about 0 Watts to about 500 Watts, from about 0 Watts to about 400 Watts, from about 0 Watts to about 200 Watts, or from about 0 Watts to about 500 Watts. If irradiation 261's power is greater than the above-noted upper limits, irradiation 261 may damage polishing pad 202's chemical composition, such as damaging polishing pad 202's polymer layer, to degrade the CMP process performed by polisher 200. If irradiation 261's power is substantially equal to 0 Watts, irradiation 261 may not have sufficient photonic energy to generate the oxidizer radicals from slurry 214. In some embodiments, irradiation 261's power, which can be adjusted by irradiation source 262's power meter, can be from about 0 Watts to about 500 Watts, from about 0 Watts to about 400 Watts, from about 0 Watts to about 200 Watts, or from about 0 Watts to about 500 Watts within an ultraviolet wavelength range (e.g., wavelengths from about 200 nm to about 450 nm, from about 200 nm to about 400 nm, or from about 250 nm to about 400 nm). If irradiation 261's power within the ultraviolet wavelength range is greater than the above-noted upper limits, irradiation 261 may damage polishing pad 202's chemical composition, such as damaging polishing pad 202's polymer layer, to degrade the CMP process performed by polisher 200. If irradiation 261's power within the ultraviolet wavelength range is substantially equal to 0 Watts, irradiation 261 may not have sufficient photonic energy to generate the oxidizer radicals from slurry 214. In some embodiments, irradiation source 262's power meter (not shown in FIG. 2A) can further determine and record irradiation 261's power. In some embodiments, polisher 200 can include a chamber (not shown in FIG. 2A) that can accommodate slurry enhancement module 260, polishing pad 202, feeder 210, substrate carrier 206 and pad conditioner 208, where polisher 200 can further include an interlock device (not shown in FIG. 2A) that can turn on or turn off irradiation source 262 based on the opening/closing status of the chamber's door (not shown in FIG. 2A). For example, the interlock device can provide a signal to indicate that the chamber's door is opened.

Referring to FIGS. 2A and 213, slurry enhancement module 260 can include a beam 264 to support and move irradiation source 262. For example, beam 264 can support irradiation source 262 above polishing pad 202 by vertically (e.g., in the z-direction) adjusting a separation $S_{262}$. Separation $S_{262}$ can be from about 1 cm to about 70 cm, from about 3 cm to about 60 cm, from about 5 cm to about 50 cm, or from about 5 cm to about 40 cm. If separation $S_{262}$ is below the above-noted lower limits, slurry 216 and/or slurry 214 that is splashed from polishing pad 202 can contaminate irradiation source 262. If separation $S_{262}$ is beyond the above-noted upper limits, irradiation source 262 may not provide sufficient irradiation 261 to enhance slurry 214's oxidizability. Beam 264 can move irradiation source 262 to adjust irradiation 261's position to irradiate slurry 214. For example, as shown in FIG. 2B, beam 264 can move irradiation source 262 within a proximity 263 of feeder 210's outlet 210B. In some embodiments, feeder 210 can move horizontally (e.g., along the x-y plane) and sweep across polishing pad 202's top surface, and beam 264 can move irradiation source 262 following feeder 210 within outlet 210B's proximity 263. Proximity 263 can represent a space within a separation $S_{263}$ from outlet 210B. Separation $S_{263}$ can be from about 5 mm to about 100 mm, from about 10 mm to about 75 mm, or from about 15 mm to about 50 mm. If separation $S_{263}$ is below the above-noted lower limits, slurry 214 splashed from outlet 210B can contaminate irradiation source 262. If separation $S_{263}$ is beyond the above-noted upper limits, portions of slurry 214 outputted from outlet 210B may not react with irradiance 261, thus degrading the CMP process performed by polisher 200. In some embodiments, a ratio of separation $S_{263}$ to polishing pad 202's diameter $D_{202}$ can be from about 0.01 to about 0.8, from about 0.03 to about 0.7, or from about 0.05 to about 0.6. If the ratio of separation $S_{263}$ to diameter $D_{202}$ is below the above-noted lower limits, slurry 214 that is splashed from outlet 210 can contaminate irradiation source 262. If the ratio of separation $S_{263}$ to diameter $D_{202}$ is beyond the above-noted upper limits, portions of slurry 214 outputted from outlet 210B may not react with irradiance 261, thus degrading the CMP process performed by polisher 200. In some embodiments, beam 264 can horizontally (e.g., along the x-y plane) move irradiation source 262 sweeping across polishing pad 202's top surface. Beam 264 can determine irradiation source 262's irradiation acute angle $\theta_{261}$ (e.g., irradiation 261's incidence angle) with respect to polishing pad 202's top surface to irradiate slurry 214. Acute angle $\theta_{261}$ can be from about 5 degrees to about 90 degrees, from about 10 degrees to about 85 degrees, or from about 15 degrees to about 90 degrees. If acute angle $\theta_{261}$ is below the above-noted lower limits, irradiation source 262 may not provide sufficient irradiation 261 to enhance slurry 214's oxidizability. If acute angle $\theta_{261}$ is beyond the above-noted upper limits, irradiation source 262 may collide with feeder 210, thus being not be able to position proximate to outlet 21011 to efficiently enhance slurry 214's oxidizability.

In some embodiments, referring to FIGS. 2A and 2C, beam 264 can move irradiation source 262 within substrate carrier 206's proximity 265. In some embodiments, substrate carrier 206 can horizontally (e.g., along the x-y plane) move sweeping across polishing pad 202's top surface, and beam 264 can move irradiation source 262 following substrate carrier 206 within substrate carrier 206's proximity 265. Proximity 265 can represent a space within a separation $S_{265}$ from substrate carrier 206. Separation $S_{265}$ can be from about 5 mm to about 120 mm, from about 10 mm to about 100 mm, or from about 15 mm to about 80 mm. If separation $S_{265}$ is below the above-noted lower limits, slurry 214 splashed from substrate carrier 206 can contaminate irradiation source 262. If separation $S_{265}$ is beyond the above-noted tipper limits, irradiance 261 may not sufficiently react with slurry 214 proximate to substrate carrier 206, thus degrading the CMP process performed by polisher 200. In some embodiments, a ratio of separation $S_{265}$ to polishing pad 202's diameter $D_{202}$ can be from about 0.01 to about 0.8, from about 0.03 to about 0.7, or from about 0.05 to about 0.6. If the ratio of separation $S_{265}$ to diameter $D_{202}$ is below the above-noted lower limits, slurry 214 splashed from substrate carrier 206 can contaminate irradiation source 262. If the ratio of separation $S_{265}$ to diameter $D_{202}$ is beyond the above-noted tipper limits, irradiance 261 may not sufficiently react with slurry 214 proximate to substrate carrier 206, thus degrading degrade the CMP process performed by polisher 200.

Polisher 200 can further include a detection module 230 to measure polishing characteristics associated with the CMP process performed by polisher 200. The polishing characteristics can include the CMP process's polishing rate, the CMP process's end-point detection, substrate 211's surface roughness, substrate 211's surface uniformity, substrate 211's surface dishing, and substrate 211's surface defect density. In some embodiments, the polishing characteristic can be associated with slurry 216's oxidizability. For example, the greater the slurry 216's oxidiazability, the greater the polishing rate, where the polishing rate can affect the CMP process's other polishing characteristics, such as affecting substrate 211's surface roughness, surface uniformity, surface dishing, and surface defect density. Detection module 230 can measure the polishing characteristic during or after the CMP process. Detection module 230 can be an in-situ monitoring apparatus attached to or embedded in platen 204. In some embodiments, detection module 230 can be attached to substrate carrier 206. Detection module 230 can include an optical interferometer or an optical reflectometer to generate an optical signal directed towards substrate 211 and detect a respective optical reflectance signal associated with a thickness or a surface roughness of a film (e.g. a copper layer) on substrate 211. In some embodiments, detection module 230 can include an electrode structure to detect an electrical current associated with the film thickness on substrate 211 or associated with the CMP process's end-point detection. In some embodiments, detection module 230 can be an apparatus to measure one or more of a mechanic displacement, a force or torque, a vibration signal, an acoustic signal, a thermal signal, and a radioactivity signal associated with the polishing characteristic.

Figure 3A:
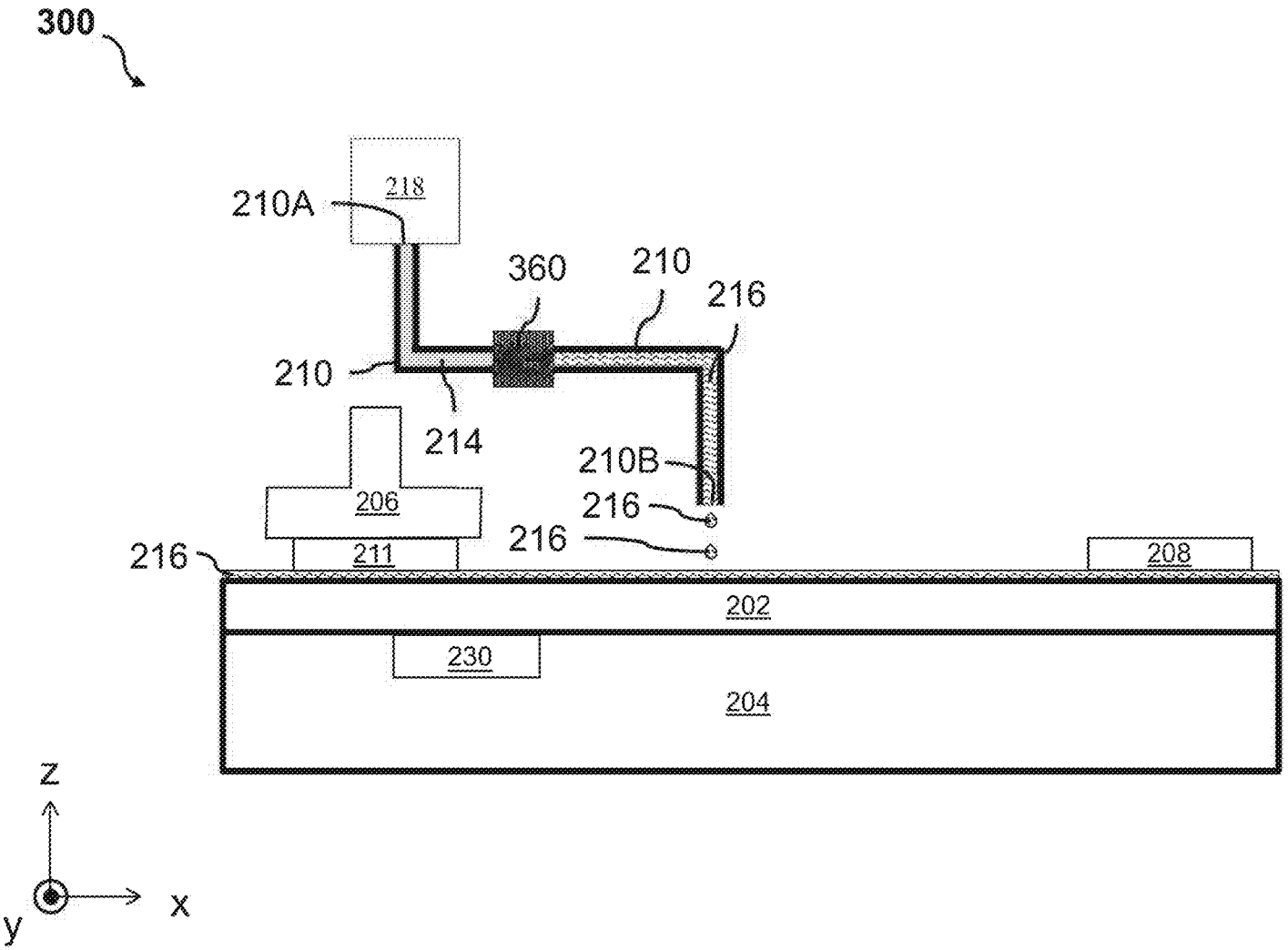
FIG. 3A illustrates a side view of a polishing apparatus, according to some embodiments.
Figure 3B:
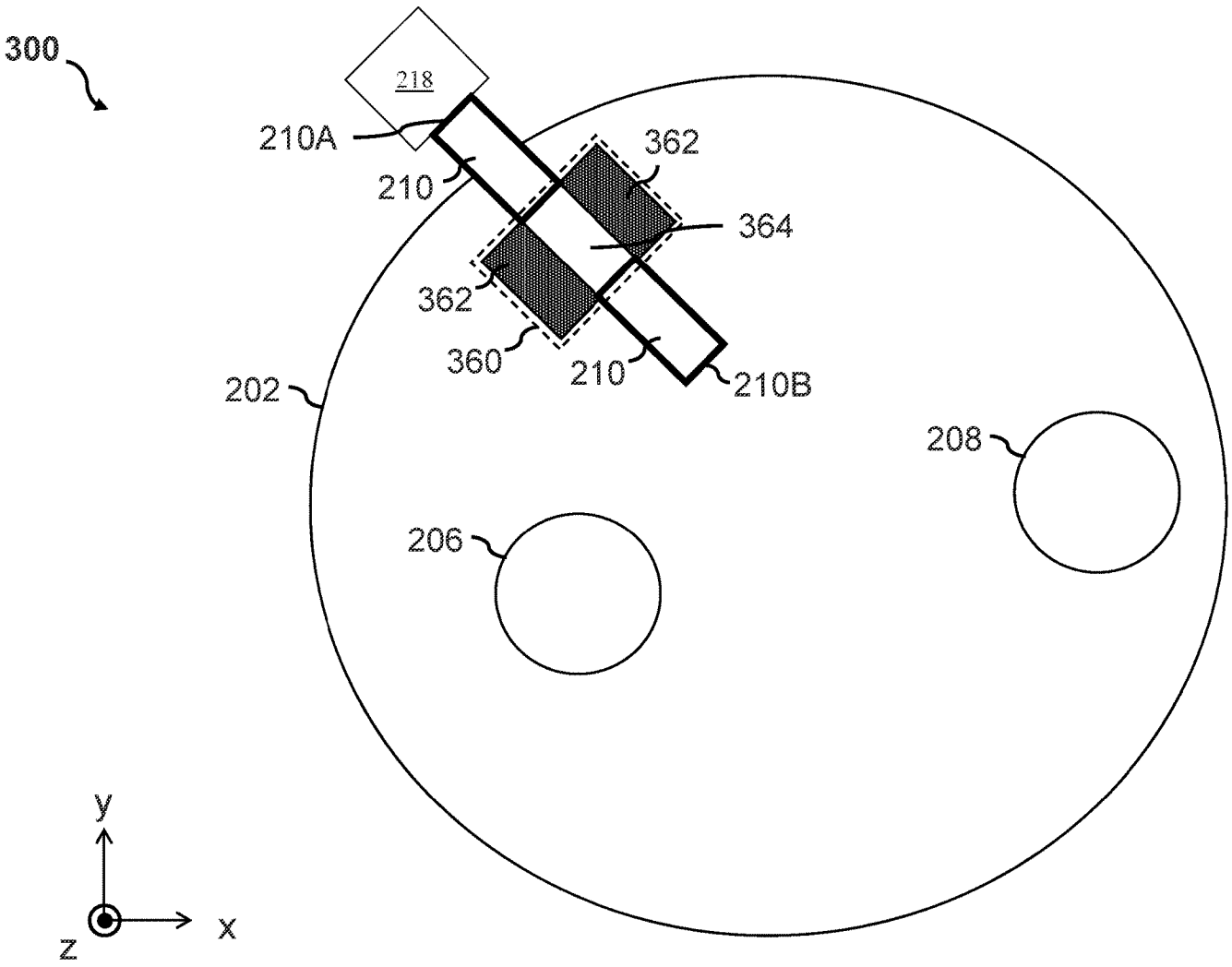
FIG. 3B illustrates a top view of a polishing apparatus, according to some embodiments.

FIG. 3A illustrates a side view of a polisher 300 configured to perform a CMP process on substrate 211, according to some embodiments. FIG. 3B illustrates a top view of polisher 200 of FIG. 2A, according to some embodiments. Polisher 300 can be an embodiment of polishing apparatus 110 or an embodiment of polisher 200. The discussion of polisher 200 applies to polisher 300, unless mentioned otherwise. Further, the discussion of elements with the same annotations in FIGS. 1, 2A-2C, 3A, and 3B applies to each other, unless mentioned otherwise. Polisher 300 can include a slurry enhancement module 360 fluidly connected with feeder 210 to enhance slurry 214's oxidizability to generate slurry 216. For example, feeder 210 can receive slurry 214 from mixing tank 218 through inlet 210A. The received slurry 214 can flow through slurry enhancement module 360, and slurry enhancement module 360 can increase the received slurry 214's oxidizability to generate slurry 216. For example, as shown in FIG. 3B, slurry enhancement module 360 can include a fluid conduit 364 fluidly connected with inlet 210A to receive slurry 214 from mixing tank 218. Slurry enhancement module 360 can further include a irradiation source 362 configured to generate an irradiation (e.g., an ultraviolet irradiation; not shown in FIG. 3B) to irradiate slurry 214 flowing through fluid conduit 364 to form slurry 216. The irradiation generated by irradiation source 362 can increase slurry 214's oxidizability as previously discussed. In some embodiments, the discussion of irradiation source 262 can be applied to irradiation source 362. In some embodiments, the discussion of irradiation 261 can be applied to the irradiation generated by irradiation source 362. Fluid conduit 364 can be further fluidly connected with outlet 210B to dispense slurry 216, via feeder 210, onto polishing pad 202 through outlet 210B. Accordingly, polisher 300 can perform the CMP process on substrate 211 using the dispensed slurry 216. In some embodiments, irradiation source 362 can surround a portion of fluid conduit 364, and the portion of fluid conduit 364 can be made of any suitable ultraviolet transparent material, such as quartz and fused silica, to allow the irradiation generated by irradiation source 362 passing through. In some embodiments, an optical transmittance between fluid conduit 364's outer and inner sidewalls can be greater than about 50%, greater than about 75%, or greater than about 90% in an ultraviolet wavelength range (e.g., wavelengths that are from about 200 nm to about 450 nm, from about 200 nm to about 400 nm, or from about 250 nm to about 400 nm). If the optical transmittance in the ultraviolet wavelength range is below the above-noted lower limits, irradiation source 362 may not sufficiently improve slurry 214's oxidizability to improve the CMP process performed by polisher 300. In some embodiments, slurry enhancement module 360 can be fluidly connected with feeder 210 and disposed between inlet 210A and outlet 210B. In some embodiments, slurry enhancement module 360 can be fluidly connected with feeder 210 and disposed at inlet 210A or at outlet 210B. In some embodiments, slurry enhancement module 360 can be fluidly connected with feeder 210, where slurry enhancement module 360 can be mobile between inlet 210A and outlet 210B.

Figure 4:
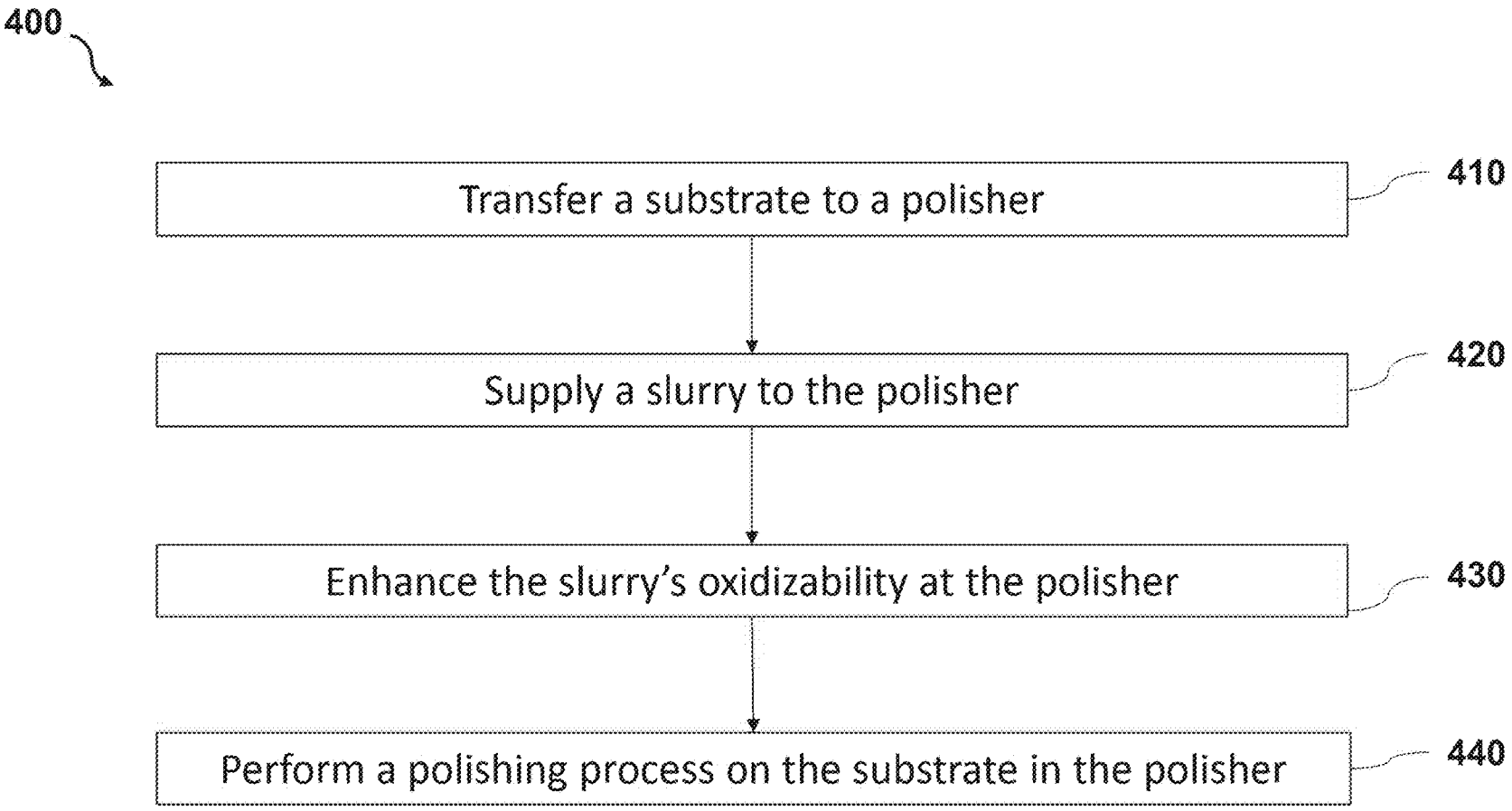
FIG. 4 illustrates a method for operating a polishing system, according to some embodiments.

FIG. 4 is a method 400 for operating a polisher as described with reference to FIGS. 1, 2A-2C, 3A, and 3B, according to some embodiments. Operations shown in method 400 are not exhaustive; other operations can be performed as well before, after, or between any of the illustrated operations. Moreover, not all operations may be needed to perform the disclosure provided herein. Further, some of the operations may be performed simultaneously, or in a different order than shown in FIG. 4. In some embodiments, operations of method 400 can be performed in a different order. Variations of method 400 are within the scope of the present disclosure.

Method 400 begins with operation 410, where a substrate can be transferred to a polisher. Referring to FIGS. 2A-2C, 3A, and 3B, for example, substrate 211 can be transferred, via a robotic arm (not shown in FIGS. 2A-2C, 3A, and 3B), to polisher 200 or polisher 300 and secured onto substrate carrier 206. In some embodiments, substrate 211 can be secured onto substrate carrier 206 by a retainer ring (not shown in FIGS. 2A-2C, 3A, and 3B). In some embodiments, a vacuum can be applied to secure substrate 211 onto substrate carrier. Accordingly, substrate carrier 206 can hold substrate 211, where the surface of substrate 211 to be polished can face polishing pad 202. In some embodiments, substrate 211's top surface can face polishing pad 202's top surface.

Referring to FIG. 4, in operation 420, a slurry is supplied to the polisher. For example, referring to FIGS. 2A-2C, 3A, and 3B, slurry 214 can be supplied to polisher 200 or polisher 300. In some embodiments, the process of supply slurry 214 can include providing used slurry recycled from a previous CMP process performed by polisher 200. In some embodiments, the process of supplying slurry 214 can include providing a raw slurry. The composition of the raw slurry can be determined based on the materials of substrate 211's surface. In some embodiments, the raw slurry can include an oxidizer, a reactant, an abrasive, and a solvent. The raw slurry's oxidizer can oxidize substrate 211's surface to form an oxide layer thereon. For example, substrate 211's surface can include a metal layer, where the raw slurry's oxidizer can oxidize the metal layer to form an oxide layer at substrate 211's surface. The raw slurry's reactant can assist polishing pad 202 to grind away (discussed at operation 440) materials, such as the oxide layer formed by slurry's oxidizer, from substrate 211's surface. The raw slurry's abrasive can be any suitable particle to planarize substrate 211's surface. The raw slurry's solvent can combine the oxidizer, the reactant, and the abrasive and can allow the raw mixture to be flowable.

The process of supplying slurry 214 can further include (i) mixing the raw slurry and deionized water in mixing tank 218 to form slurry 214 in mixing tank 218, and (ii) fluidly delivering slurry 214 from mixing tank 218 to feeder 210. In some embodiments, slurry 214 can be stored in mixing tank 218 for any suitable time duration (e.g., several hours or several days) before being fluidly delivered to feeder 210. In some embodiments, the process of fluidly delivering slurry 214 can include (i) flowing, via feeder 210's pump (not shown in FIGS. 2A-2C, 3A, and 3B), slurry 214 from mixing tank 218 to feeder 210 (e.g., through inlet 210A); and (ii) adjusting, via feeder 210's flow regulator (not shown in FIGS. 2A-2C, 3A, and 3D), slurry 214's flow rate in feeder 210 (e.g., between inlet 210A and outlet 210B). In some embodiments, the process of supplying slurry 214 can further include dispensing, via feeder 210 and through outlet 210B, slurry 214 towards polishing pad 202. In some embodiments, the process of supplying slurry 214 can further include dispensing, via feeder 210, slurry 214 through slurry enhancement module 360. In some embodiments, feeder 210 can control a dispensing rate of dispensing slurry 214 towards polishing pad 202.

Referring to FIG. 4, in operation 430, the slurry's oxidizability is enhanced at the polisher. For example, referring to FIGS. 2A-2C, 3A, and 3B, slurry 214's oxidizability can be enhanced to form slurry 216 in polisher 200 or polisher 300. The process of enhancing slurry 214's oxidizability can include generating an irradiation (e.g., irradiation 261) via irradiation sources 262 and/or 362. In some embodiments, the process of generating irradiation 261 can include adjusting irradiation 261's wavelength to adjust slurry 216's oxidiability. For example, slurry 216's oxidiability can be increased by reducing irradiation 261's wavelength because the reduced irradiation 261's wavelength can increase oxidizer radicals' concentration in slurry 216. Similarly, slurry 216's oxidiability can be decreased by increasing irradiation 261's wavelength because the increased irradiation 261's wavelength can reduce oxidizer radicals' concentration in slurry 216. In some embodiments, the process of generating irradiation 261 can include adjusting irradiation 261's power to adjust slurry 216's oxidiability. For example, slurry 216's oxidiability can be increased by increasing irradiation 261's power to increase oxidizer radicals' concentration in slurry 216. Similarly, slurry 216's oxidiability can be decreased by decreasing irradiation 261's power to decrease oxidizer radicals' concentration in slurry 216. In some embodiments, the process of generating irradiation 261 can be performed concurrently with operation 420. For example, the process of generating irradiation 261 can be performed during fluidly delivering slurry 214 from mixing tank 218 to feeder 210. In some embodiments, the process of generating irradiation 261 can be performed substantially at the onset of fluidly delivering slurry 214 from mixing tank 218 to feeder 210.

The process of enhancing slurry 214's oxidizability can further include irradiating slurry 214 via irradiation 261. In some embodiments, the process of irradiating slurry 214 can include irradiating, via irradiation source 262, feeder 210's outlet 210B and/or substrate carrier 206. For example, as shown in FIG. 2A, beam 264 can vertically (e.g., in the z-direction) move irradiation source 262 to adjust separation $S_{262}$. Further, as shown in FIGS. 2B and 2C, beam 264 can horizontally (e.g., along the x-y plane) move irradiation source 262 within outlet 210B's proximity 263 and/or within substrate carrier 206's proximity 265. Accordingly, slurry 214 that is dispensed from outlet 210B can be irradiated by irradiation 261 to form slurry 216. Slurry 216 can subsequently drop onto polishing pad 202 for the polishing process on substrate 211 (discussed at operation 440).

In some embodiments, the process of irradiating slurry 214 can include adjusting, via beam 264, irradiation source 262's irradiation angle $\theta_{261}$ (e.g., irradiation 261's incidence angle) to aim irradiation 261 at slurry 214, such as aiming irradiation 261 at outlet 210B's proximity. In some embodiments, the process of irradiating slurry 214 can include horizontally (e.g., along the x-y plane) moving, via beam 264, irradiation source 262 to aim irradiation 261 at slurry 214. In some embodiments, the process of irradiating slurry 214 can include vertically (e.g., along the z-direction) moving irradiation source 262 to aim irradiation 261 at slurry 214. In some embodiments, the process of irradiating slurry 214 can include irradiating, via irradiation source 262, polishing pad 202. For example, irradiation source 262 can generate irradiation 261 to irradiate portions of polishing pad 202's top surface space under outlet 210B, under substrate carrier 206, proximate to substrate carrier 206, under conditioner 208, or under conditioner 208. Accordingly, slurry 214 that is dispensed from outlet 210B can be irradiated by irradiation 261 to form slurry 216 on polishing pad 202. In some embodiments, irradiation source 262 can be moved, via beam 264, by following the movement of outlet 210B, following the movement of substrate carrier 206, following the movement of substrate 211 or following the movement of conditioner 208 to respectively irradiate the proximity of outlet 210B, irradiate the proximity of substrate carrier 206, irradiate the proximity of substrate 211 or irradiate the proximity of conditioner 208. In some embodiments, the process of irradiating slurry 214 can include fluidly irradiating, via slurry enhancement module 360, slurry 214 received by feeder 210. For example, as shown in FIG. 3A, slurry enhancement module 360 can fluidly connect with feeder 210 to irradiate slurry 214 flowing into feeder 210 (e.g., flowing between inlet 210A and outlet 210B) to form slurry 216 at outlet 210B. Accordingly, feeder 210 can dispense slurry 216 onto polishing pad 202 for the polishing process on substrate 211 (discussed at operation 440).

Referring to FIG. 4, in operation 440, a polishing process is performed on the substrate in the polisher. For example, referring to FIGS. 2A-2C, 3A, and 3B, a CMP process can be performed on substrate 211 in polisher 200 or polisher 300. The CMP process can include (i) dispensing slurry 216, generated at operation 430, onto polishing pad 202; (ii) pressing, via substrate carrier 206, substrate 211 in contact with slurry 216 and against polishing pad 202; and (iii) polishing (e.g., grinding) substrate 211 by rotating substrate carrier 206, moving (e.g., along the x-y plane) substrate carrier 206 and/or rotating, via platen 204, polishing pad 202. Since slurry 216 has an enhanced oxidizability, the CMP process can have an improve yield and reliability compared to a CMP process that uses slurry 214. In some embodiments, operation 430 can be performed concurrently with operation 440. For example, irradiation source 262 can be activated to provide irradiation 261 during the CMP process of operation 440, such as during the rotation of polishing pad 202 or during the rotation of substrate carrier 206. In some embodiments, irradiation source 262 can be deactivated to stop irradiation 261 before the polishing process and/or after the polishing process. In some embodiments, irradiation source 262 can be activated to provide irradiation 261 during a first portion of the CMP process for removing a first material layer (e.g., a metal layer) of substrate 211, and irradiation source 262 can be deactivated to stop irradiation 261 during a second portion of the CMP process for removing a second material layer (e.g., a dielectric layer) of substrate 211.

In some embodiments, the CMP process can further include determining, via detection module 230, a polishing characteristic associated with the CM P process. In some embodiments, the polishing characteristic can include an end-point detection to determine if a material layer (e.g., a metal layer) has been substantially removed from substrate 211 by the CMP process. In some embodiments, irradiation source 262 can be deactivated based on the end-point detection. For example, irradiation source 262 can be deactivated to stop irradiation 261 at the onset of the end-point detection that indicates a substantially removal of a material layer (e.g., a metal layer) from substrate 211. In some embodiments, irradiation source 262 can adjust irradiation 261's wavelength or adjust irradiation 261's power based on the end-point detection. For example, irradiation source 262 can increase irradiation 261's wavelength or decrease irradiation 261's power at the onset of the end-point detection to reduce a polishing rate of the CMP process. In some embodiments, operation 440 can include stopping the CMP process based on a signal from the interlock device (not shown in FIGS. 2A-2C, 3A, and 3B) of polisher 200 and polisher 300. In some embodiments, irradiation source 262 can be deactivated based on the signal from the interlock device.

Figure 5:
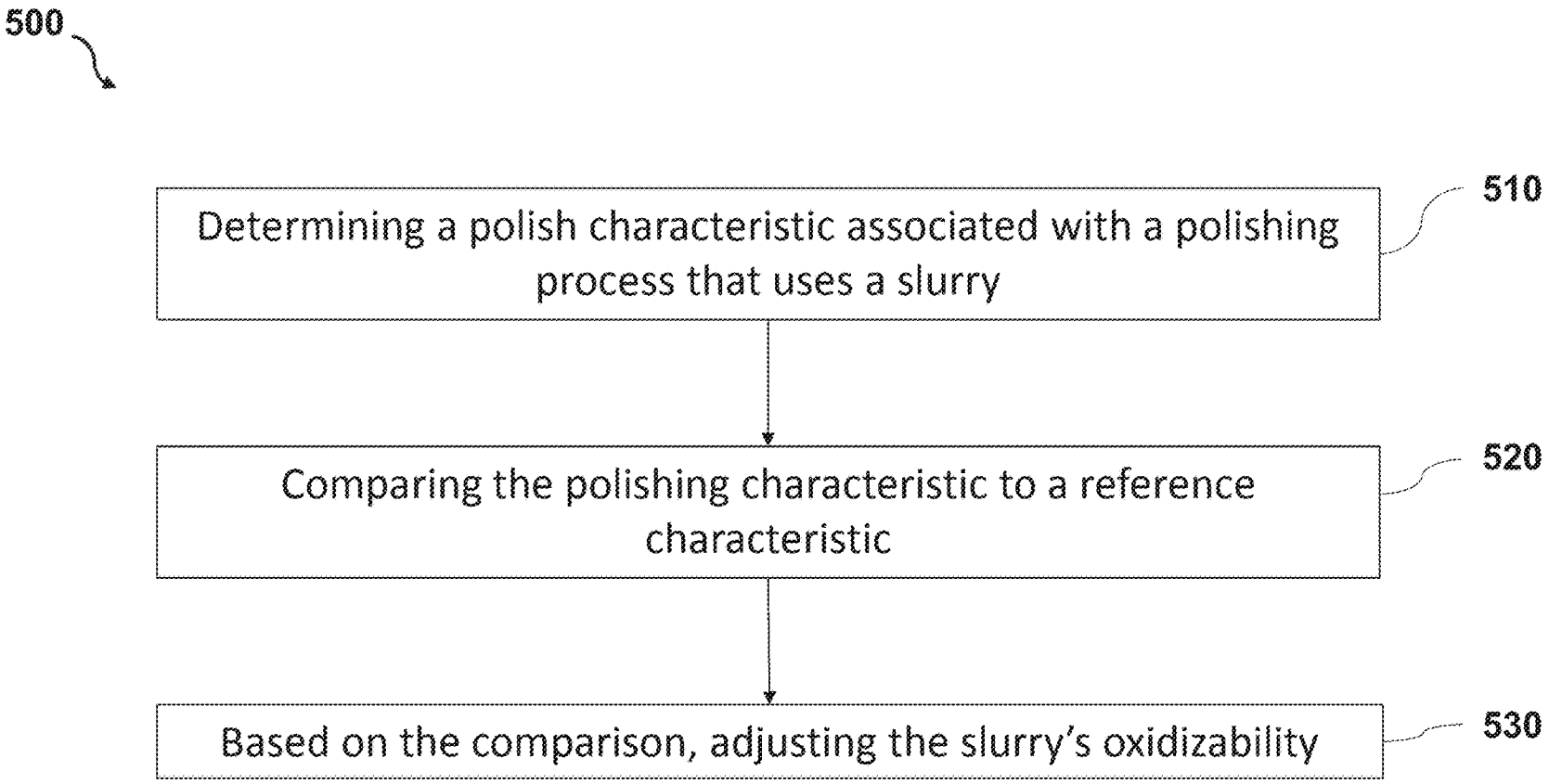
FIG. 5 illustrates a method for operating a polishing system, according to some embodiments.

FIG. 5 is a method 500 for operating a polisher as described with reference to FIGS. 1, 2A-2C, 3A, and 3B, according to some embodiments. Operations shown in method 500 are not exhaustive; other operations can be performed as well before, after, or between any of the illustrated operations. Moreover, not all operations may be needed to perform the disclosure provided herein. Further, some of the operations may be performed simultaneously, or in a different order than shown in FIG. 5 In some embodiments, operations of method 500 can be performed in a different order. Variations of method 500 are within the scope of the present disclosure.

Method 500 begins with operation 510, where a polishing characteristic associated with a polishing process using a slurry is determined. For example, the polishing process can be a CMP process, performed by polishers 200 or 300, that can use slurry 216 to polish substrate 211 or condition polishing pad 202. The polishing characteristic associated with the polishing process can include a polishing rate of removing a material layer from substrate 211, an existence of a material layer on substrate 211 (e.g., end-point detection), substrate 211's surface roughness, substrate 211's surface uniformity, substrate 211's surface dishing, or substrate 211's surface defect density. The polishing characteristic can be determined by detection module 230, where detection module 230 can be measure an optical reflection, an optical refraction, an optical scattering, or an electrical current associated with the polishing process. For example, detection module 230 can be an optical reflectometer configured to transmit an optical signal towards substrate 211 and receive a respective optical reflectance associated a material layer's profile on substrate 211's surface. In some embodiments, detection module 230 can be an electrode structure to measure an electrical current from substrate 211 associated with the material layer's thickness undergoing and during the polishing process. In some embodiments, the polishing characteristic can be determined by an external detection module (not shown in FIGS. 2A-2C, 3A, and 3B). For example, a surface roughness and/or dishing (e.g., a polishing characteristic) of substrate 211 can be measured by a stand-alone atomic force microscopy (AFM) apparatus.

Referring to FIG. 5, in operation 520, the polishing characteristic is compared to a reference characteristic. The reference characteristic can be one or more of a pre-determined polishing rate, a pre-determined threshold of surface roughness, and a pre-determined threshold of surface defect density of substrate 211 associated with the polishing process. The reference characteristic can represent or be associated with a desired polishing result of the polishing process. For example, the reference characteristic can be a pre-determined threshold of substrate roughness that meets a product specification after the polishing process. For example, the polishing process maintained at the pre-determined polishing rate can be expected to planarize substrate 211 with desired surface uniformity or manufacturing throughput. In some embodiments, the reference characteristic can be determined or learned from one or more historical polishing processes similar or identical to the polishing process. The comparison between the polishing characteristic and the reference characteristic can include subtracting the polishing characteristic from the reference characteristic. In some embodiments, the comparison can include subtracting the polishing characteristic from an averaged attribute (e.g., an averaged surface roughness from one or more areas of the target substrate) of the reference characteristic.

Referring to FIG. 5, in operation 530, the slurry's oxidizability is adjusted based on the comparison between the polishing characteristic and the reference characteristic. As discussed previously, slurry 216's oxidizability can affect a polishing characteristic of the CMP process performed by polisher 200 or 300. Accordingly, the process of adjusting slurry 216's oxidizability can include adjusting irradiation 261's wavelength, adjusting irradiation 261's power, adjusting irradiation source 262's position (e.g., along the x-y plane or along the z-direction), or adjusting irradiation source 262's angle $\theta_{261}$. As a result, the process of adjusting slurry 216's oxidizability can tune the radicals' concentration in slurry 216 to alter the respective polishing characteristic to minimize a deviation between the respective polishing characteristic and the reference characteristic. In some embodiments, the process of adjusting slurry 216's oxidizability can include increasing slurry 216's oxidizability (e.g., by increasing irradiation 261's power, by decreasing irradiation 261's wavelength, by moving radiation source 262's position/angle to increase the efficiency of irradiating slurry 214) to increase the polishing process's polishing rate to minimize a deviation between the respective polishing characteristic and the reference characteristic. In some embodiments, the process of adjusting slurry 216's oxidizability can include decreasing slurry 216's oxidizability (e.g., by decreasing irradiation 261's power, by increasing irradiation 261's wavelength, by moving radiation source 262's position/angle to reduce irradiating slurry 214) to decrease the polishing process's polishing rate to minimize a deviation between the respective polishing characteristic and the reference characteristic. In some embodiments, operation 530 can be concurrently performed with operation 510. In some embodiments, the adjustment can further include tuning a dispensing rate of slurry 214 via feeder 210.

The present disclosure provides a polishing apparatus and a method that enhances a slurry's oxidizability and performs a CMP process using the enhanced slurry. The polishing apparatus can include a feeder that receive a slurry. The polishing apparatus can further include a slurry enhancement module to enhance the oxidizability of the received slurry to form an enhanced slurry. For example, the slurry enhancement module can include an irradiation source to provide an irradiation, such as an ultraviolet irradiation, to generate radicals in the received slurry to form the enhanced slurry. The polishing apparatus can further include a polishing pad to receive the enhanced slurry and perform the CMP process via the enhancement slurry. The feeder, pad, and the slurry enhancement module can be accommodated in a same chamber of the polishing apparatus. The slurry enhancement module can be selectively activated to provide the enhanced slurry during the CMP process, thus boosting the CMP process's polishing rate. Further, the slurry enhancement module can be deactivated to stop generating the enhanced slurry before or after the CMP process. A benefit of the present disclosure, among others, is to provide the slurry with enhanced oxidizability selectively during the CMP process, thus improving the CMP process's reliability and reducing the CMP process's manufacturing cost.

Figure 6:
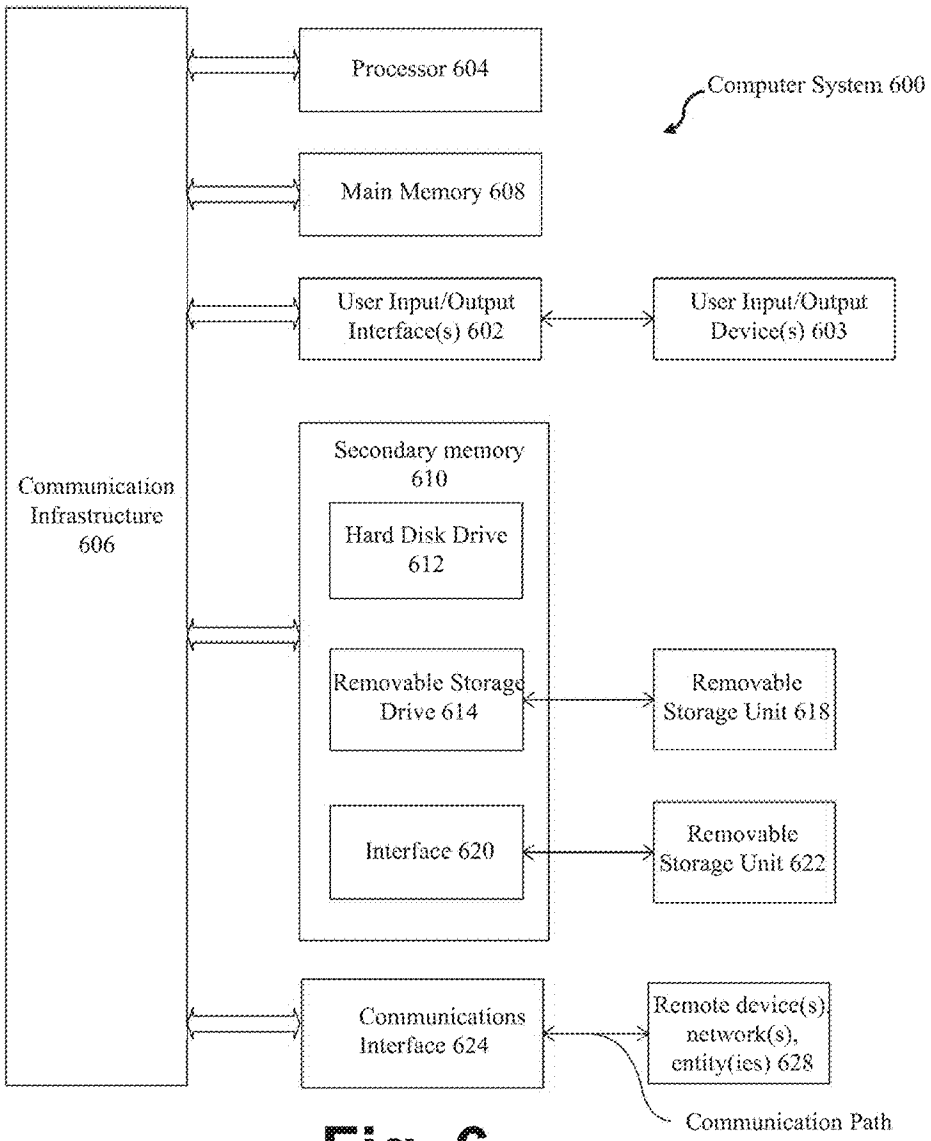
FIG. 6 illustrates a computer system for implementing various embodiments of the present disclosure, according to some embodiments.

FIG. 6 is an illustration of an example computer system 600 in which various embodiments of the present disclosure can be implemented, according to some embodiments. Computer system 600 can be used, for example, in computer system 130 of FIG. 1. Computer system 600 can be any well-known computer capable of performing the functions and operations described herein. Computer system 600 can be used, for example, to execute one or more operations of polishing apparatus 110, polishers 200, polisher 300, and methods 400 and 500.

Computer system 600 also includes a main memory 608, such as random access memory (RAM), and may also include a secondary memory 610. Secondary memory 610 can include, for example, a hard disk drive 612, a removable storage drive 614, and/or a memory stick. Removable storage drive 614 can include a floppy disk drive, a magnetic tape drive, an optical disk drive, a flash memory, or the like. Removable storage drive 614 reads from and/or writes to a removable storage unit 618 in a well-known manner. Removable storage unit 618 can include a floppy disk, magnetic tape, optical disk, flash drive, etc., which is read by and written to by removable storage drive 614. Removable storage unit 618 includes a computer-readable storage medium having stored therein computer software and/or data. Computer system 600 includes a display interface 602 (which can include input and output devices 603, such as keyboards, mice, etc.) that forwards graphics, text, and other data from communication infrastructure 606 (or from a frame buffer not shown).

In alternative implementations, secondary memory 610 can include other similar devices for allowing computer programs or other instructions to be loaded into computer system 600 (e.g. loaded into main memory 608). Such devices can include, for example, a removable storage unit 622 and an interface 620. Examples of such devices include a program cartridge and cartridge interface (such as those found in video game devices), a removable memory chip (e.g., EPROM or PROM) and associated socket, and other removable storage units 622 and interfaces 620 which allow software and data to be transferred from the removable storage unit 622 to computer system 600.

Computer system 600 can also include a communications interface 624. Communications interface 624 allows software and data to be transferred between computer system 600 and external devices. Communications interface 624 can include a modem, a network interface (such as an Ethernet card), a communications port, or the like. Software and data transferred via communications interface 624 are in the form of signals which may be electronic, electromagnetic, optical, or other signals capable of being received by communications interface 624. These signals are provided to communications interface 624 via a communications path 626. Communications path 626 carries signals and can be implemented using wire or cable, fiber optics, a phone line, a cellular phone link, a RF link, or other communications channels.

In this document, the terms "computer program storage medium" and "computer-readable storage medium" are used to generally refer to non-transitory media such as removable storage unit 618, removable storage unit 622, and a hard disk installed in hard disk drive 612. Computer program storage medium and computer-readable storage medium can also refer to memories, such as main memory 608 and secondary memory 610, which can be semiconductor memories (e.g., DRAMs, etc.). Embodiments of the present disclosure can employ any computer-readable medium, known now or in the future. Examples of computer-readable storage media include, but are not limited to, non-transitory primary storage devices (e.g., any type of random access memory), and non-transitory secondary storage devices (e.g., hard drives, floppy disks, CD ROMS, ZIP disks, tapes, magnetic storage devices, optical storage devices, MEMS, nanotechnological storage devices, etc.).

These computer program products provide software to computer system 600. Embodiments of the present disclosure are also directed to computer program products including software stored on any computer-readable storage medium. Such software, when executed in one or more data processing devices, causes a data processing device(s) to operate as described herein.

Computer programs (also referred to herein as "computer control logic") are stored in main memory 608 and/or secondary memory 610. Computer programs may also be received via communications interface 624. Such computer programs, when executed, enable computer system 600 to implement various embodiments of the present disclosure. In particular, the computer programs, when executed, enable processor 604 to implement processes of embodiments of the present disclosure, such as the operations in method 400 illustrated by FIG. 4 and method 500 illustrated by FIG. 5. Where embodiments of the present disclosure are implemented using software, the software can be stored in a computer program product and loaded into computer system 600 using removable storage drive 614, interface 620, hard drive 612, or communications interface 624.

The functions/operations in the preceding embodiments can be implemented in a wide variety of configurations and architectures. Therefore, some or all of the operations in the preceding embodiments—e.g., functions of polishing system 100 described in FIG. 1, functions of polisher 200 described in FIGS. 2A-2C, functions of polisher 300 described in FIGS. 3A and 3B, method 400 illustrated by FIG. 4, and method 500 described in FIG. 5—can be performed in computer system 600 (e.g. by processor 604), in hardware, in software or in combination thereof. In some embodiments, a tangible apparatus or article of manufacture including a tangible computer useable or readable medium having control logic (software) stored thereon is also referred to herein as a computer program product or program storage device. This includes, but is not limited to, computer system 600, main memory 608, secondary memory 610 and removable storage units 618 and 622, as well as tangible articles of manufacture embodying any combination of the foregoing. Such control logic, when executed by one or more data processing devices (such as computer system 600), causes such data processing devices to operate as described herein. For example, the hardware/equipment can be connected to or be part of element 628 (remote device(s), network(s), entity(ies) 628) of computer system 600.

In some embodiments, a method can include securing a substrate onto a carrier of a polishing system. The method can further include dispensing, via a feeder of the polishing system, a first slurry towards a polishing pad of the polishing system. The method can further include forming a second slurry by enhancing an oxidizability of the first slurry, and performing a polishing process, with the second slurry, on the substrate.

In some embodiments, a method can include providing a substrate to a polishing system. The method can further include receiving, via a feeder of the polishing system, a first slurry. The method can further include irradiating the first slurry to form a second slurry with a higher oxidizability than that of the first slurry, and performing a polishing process, with the second slurry, on the substrate.

In some embodiments, an apparatus can include a substrate carrier configured to hold a substrate, a polishing pad disposed under the substrate carrier and configured to polish the substrate, a feeder configured to receive a slurry and dispense the slurry towards the polishing pad, and a slurry enhancement module disposed over the polishing pad and configured to enhance an oxidizability of the slurry.

The foregoing disclosure outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A method, comprising:

securing a substrate onto a carrier of a polishing system;

dispensing, via a feeder of the polishing system, a first slurry towards a polishing pad of the polishing system, wherein the feeder is movable;

moving an irradiation source to follow the feeder, while dispensing the first slurry;

forming, via the irradiation source, a second slurry by enhancing an oxidizability of the first slurry; and performing a polishing process, with the second slurry, on the substrate.

2. The method of claim 1, wherein forming, via the irradiation source, the second slurry comprises irradiating the first slurry with an ultraviolet light.

3. The method of claim 2, wherein irradiating the first slurry comprises:

generating, via an ultraviolet light source, the ultraviolet light with a wavelength from about 200 nm to about 500 nm; and irradiating the first slurry with the ultraviolet light.

4. The method of claim 1, wherein forming, via the irradiation source, the second slurry comprises irradiating the feeder with an ultraviolet light.

5. The method of claim 1, wherein forming, via the irradiation source, the second slurry comprises irradiating the polishing pad with an ultraviolet light during the polishing process.

6. The method of claim 1, wherein performing the polishing process comprises performing first and second polishing processes using the first and second slurries, respectively.

7. The method of claim 1, wherein performing the polishing process comprises:

dispensing the second slurry onto the polishing pad; and pressing the substrate onto the polishing pad.

8. A method, comprising:

providing a substrate to a polishing system;

receiving, via a feeder of the polishing system, a first slurry while moving the feeder horizontally;

moving, while receiving the first slurry, an irradiation source to follow the feeder;

irradiating, via the irradiation source, the first slurry to form a second slurry with a higher oxidizability than that of the first slurry; and performing a polishing process, with the second slurry, on the substrate.

9. The method of claim 8, wherein:

receiving the first slurry comprises providing the first slurry to an inlet of the feeder; and irradiating the first slurry comprises:

irradiating the first slurry in the feeder to form the second slurry; and dispensing the second slurry through an outlet of the feeder.

10. The method of claim 8, wherein:

receiving the first slurry comprises providing the first slurry to the feeder;

irradiating the first slurry comprises:

dispensing the first slurry through an outlet of the feeder; and irradiating the dispensed first slurry to form the second slurry.

11. The method of claim 8, wherein irradiating, via the irradiation source, the first slurry comprises irradiating the first slurry with an ultraviolet light.

12. The method of claim 8, wherein irradiating, via the irradiation source, the first slurry comprises irradiating an outlet of the feeder with an ultraviolet light.

13. The method of claim 8, wherein performing the polishing process comprises:

dispensing the second slurry onto a polishing pad of the polishing system; and pressing the substrate against the polishing pad.

14. The method of claim 8, wherein irradiating the first slurry comprises irradiating the first slurry during the polishing process.

15. An apparatus, comprising:

a substrate carrier configured to hold a substrate;

a polishing pad disposed under the substrate carrier and configured to polish the substrate;

a feeder configured to:

receive a slurry and dispense the slurry towards the polishing pad; and move across a top surface of the polishing pad; and a slurry enhancement module disposed over the polishing pad and configured to enhance an oxidizability of the slurry, wherein the slurry enhancement module is configured to move and follow the feeder while the slurry is being dispensed.

16. The apparatus of claim 15, wherein the slurry enhancement module comprises an ultraviolet (UV) light source configured to irradiate the feeder.

17. The apparatus of claim 15, wherein the slurry enhancement module comprises an ultraviolet (UV) light source configured to irradiate the polishing pad.

18. The apparatus of claim 15, wherein the feeder is configured to dispense the slurry through an outlet of the feeder, and wherein the slurry enhancement module comprises an ultraviolet (UV) light source configured to irradiate the outlet of the feeder.

19. The apparatus of claim 15, wherein the slurry enhancement module comprises an ultraviolet (UV) light source and a beam configured to support the UV light source and move the UV light source to follow the feeder, and wherein the UV light source is further configured to move along the beam.

20. The apparatus of claim 15, wherein the slurry enhancement module comprises an ultraviolet (UV) light source and a beam configured to support the UV light source, and wherein the UV light source is further configured to adjust an irradiation angle with respect to the polishing pad.

* * * * *